US006668762B1

(12) United States Patent
Khosrowyar

(10) Patent No.: US 6,668,762 B1
(45) Date of Patent: Dec. 30, 2003

(54) INDIRECT FIRED PROCESS HEATER

(76) Inventor: Parviz Khosrowyar, 1007 E. Admiral Blvd., Tulsa, OK (US) 74120

( * ) Notice: Subject to any disclaimer, the term of this patent is extended or adjusted under 35 U.S.C. 154(b) by 0 days.

(21) Appl. No.: 10/417,902

(22) Filed: Apr. 17, 2003

(51) Int. Cl.[7] ..... F24H 1/12
(52) U.S. Cl. ..... 122/18.1; 122/18.2; 122/367.1
(58) Field of Search ..... 122/18.1, 18.2, 122/18.3, 31.1, 31.2, 367.1, 367.2, 19.1, 33; 165/140, 163; 62/50.2

(56) References Cited

U.S. PATENT DOCUMENTS

| | | | | |
|---|---|---|---|---|
| 3,724,426 | A | 4/1973 | Brown | 122/33 |
| 3,986,340 | A | 10/1976 | Bivins, Jr. | 62/53 |
| 4,096,909 | A | 6/1978 | Jukkola | 165/76 |
| 4,421,062 | A | 12/1983 | Padilla, Sr. | 122/1 |
| 4,499,055 | A | 2/1985 | DiNicolantonio et al. | 422/197 |
| 4,720,263 | A | 1/1988 | Green | 432/222 |
| 4,778,586 | A | 10/1988 | Bain et al. | 208/132 |
| 5,320,071 | A | 6/1994 | Valenti et al. | 122/18 |
| 5,419,392 | A | 5/1995 | Maruyama | 165/163 |
| 5,758,717 | A | 6/1998 | Crossman | 165/45 |
| 5,921,206 | A | 7/1999 | Sams | 122/367 |
| 5,988,283 | A | 11/1999 | Gann | 166/357 |
| 6,047,767 | A | 4/2000 | Bodhaine et al. | 165/141 |
| 6,095,240 | A | 8/2000 | Hassanein et al. | 165/141 |
| 2002/0003223 | A1 | 1/2002 | Smith et al. | 252/67 |

*Primary Examiner*—Jiping Lu
(74) *Attorney, Agent, or Firm*—Head, Johnson & Kachigian

(57) ABSTRACT

An indirect fired process heater apparatus and method. The apparatus includes a toroidal shell having an outer cylinder and an inner cylinder forming a fluid tight enclosure. A plurality of helical heat transfer coils have transfer fluid passing therethrough wherein said heat transfer coils form an axial passageway. A burner directs heat into the axial passageway. The toroidal shell is in fluid communication with the heat transfer coils in order to circulate the heat transfer fluid therethrough. A plurality of helical process heating coils pass through the toroidal shell in order to heat process fluid passing through the process heating coils.

17 Claims, 3 Drawing Sheets

INDIRECT FIRED PROCESS HEATER

BACKGROUND OF THE INVENTION

1. Field of the Invention

The present invention is directed to an indirect fired process heater for heating process fluids such as natural gas or oil or any liquids or any gas. In particular, the present invention is directed to an indirect fired process heater wherein heat transfer fluid is heated in order to heat the process fluid.

2. Prior Art

Indirect fired process heaters are known to heat process fluids such as a liquid or a gas which might be employed in chemical, petroleum, or other industrial applications. For example, natural gas in a pipe that passes through a pipeline transmission/distribution system may be periodically heated for transmission purposes. Keeping the natural gas above a certain temperature will prevent water from condensing and/or freezing in or on a natural gas pipeline. Another industrial application would be as a preheater for further processing, such as natural gas processing. A further application of indirect fired process heaters is in fuel gas conditioning units.

In a standard indirect fired process heater, a quantity of heat transfer fluids is initially heated in a vessel with the fluids remaining static in the vessel. Heat retained by the heat transfer fluid is transferred to the process fluid. Thus, the process fluid is indirectly heated rather than directly heated. An indirect fired process heater provides more uniform temperature control than a direct fired heater and also reduces the likelihood of fire or explosion when heating combustible process fluids such as natural gas. The heat transfer fluid may be of different types, one type being a mixture of glycol and water. Ethylene glycol, propylene glycol or other types of glycol might be utilized.

Sams (U.S. Pat. No. 5,921,206) discloses an example of a conventional indirect process fluid heater with a novel baffle system. As in indirect fired process heaters to date, the entire vessel would be filled with heat transfer fluid medium.

It would be desirable to provide an indirect fired process heater which is more efficient than existing indirect fired process heaters.

It would be desirable to provide an indirect fired process heater that requires less heat process fluid to be heated than conventionally required for an equivalent output.

It would also be desirable to provide an indirect fired process heater that can start up from cold shutdown condition to full flow operation in a substantially shorter time period than a conventional indirect fired heater.

It would be desirable to provide an indirect fired process heater wherein the length of the heater could be decreased and the weight of the heater could be decreased from a conventional indirect fired heater.

It would be desirable to provide an indirect fired heater that can operate with low-nox burners which will reduce nox.

SUMMARY OF THE INVENTION

The present invention provides an improved indirect fired process heater apparatus and method. The apparatus includes a toroidal shell having an outer cylinder and a smaller diameter inner cylinder. The outer cylinder and inner cylinder together form a fluid tight enclosure for containing heat transfer fluid.

A plurality of helical heat transfer fluid coils are positioned within the toroidal shell and are coaxial therewith.

The helical heat transfer coils have a radius less than the inner cylinder. The heat transfer fluid coils contain a heat transfer fluid which passes therein and therethrough. The heat transfer fluid is directed from the heat transfer fluid coils through a line into the toroidal shell where the heat transfer fluid circulates and thereafter is returned by a pump via a line back to the heat transfer fluid coils. A closed loop, circulating system is thereby formed.

A burner at one end of the vessel supplies heat to an axial passageway formed by the helical heat transfer fluid coils. Heat from the burner is directed into and through the axial passageway by a fan, fan/blower or natural draft type burners. The heat directed by the fan/blower or natural gas burner passes generally axially through the axial passageway.

A plurality of helical process fluid heating coils are positioned within the apparatus and are coaxial with but independent from the heat transfer fluid coils. The process fluid heating coils pass through the toroidal shell so that the process coils are in heat exchange relationship with the heat transfer fluid. The helical process fluid coils each have an axial diameter which is intermediate between the outer cylinder and the inner cylinder. The process fluid, such as natural gas, enters through an intake, passes through the helical process fluid heating coils, and thereafter exits through an outlet.

Hot combustion products (hereinafter referred to as "flue gases") generated by the burner passes into and through the axial passageway and thereafter reverses direction and passes through an annulus formed by the exterior of the heat transfer fluid coils and the inner cylinder of the toroidal shell. Thereafter, these cooled flue gases are permitted to move out of an exhaust stack extending radially from the apparatus.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
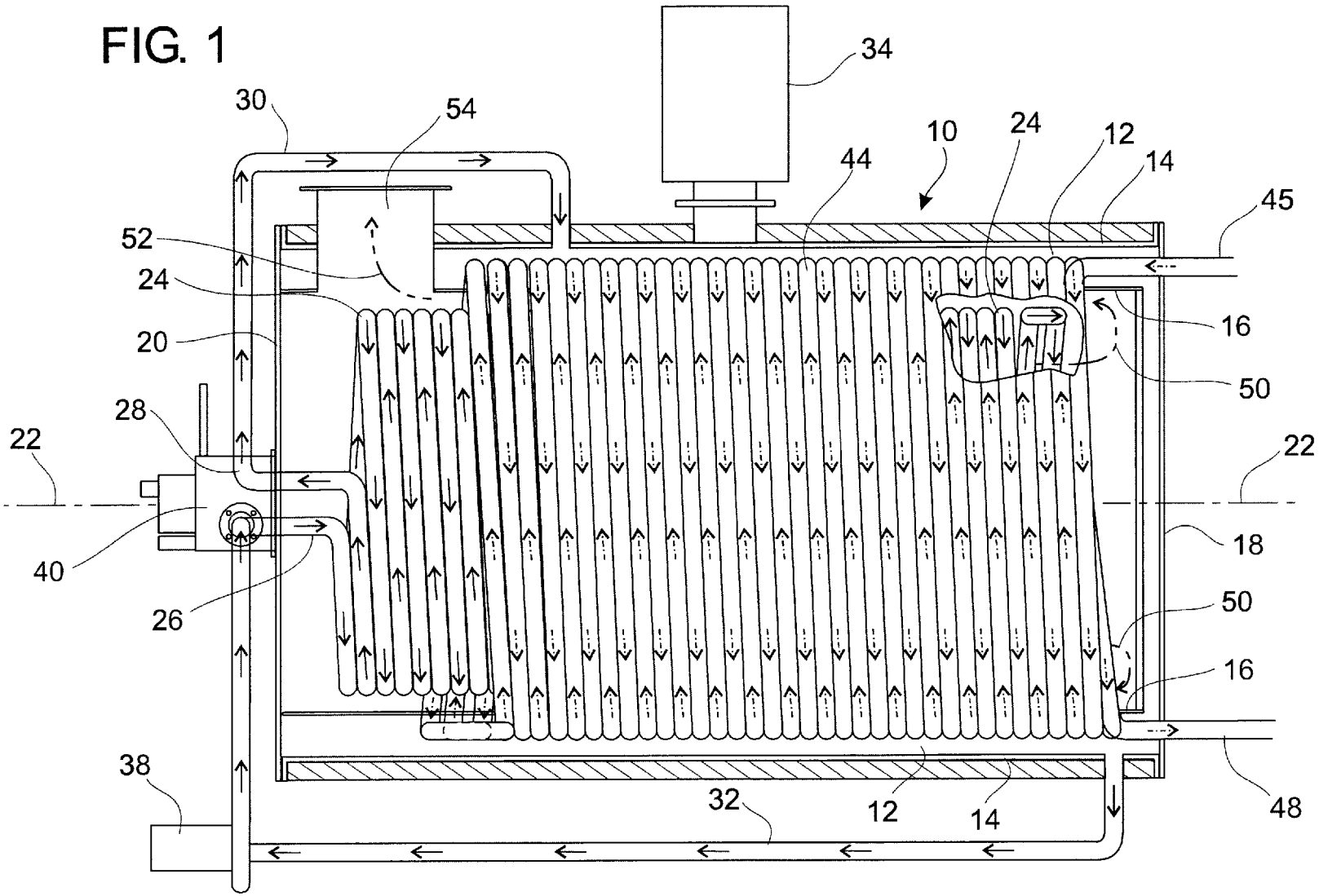
FIG. 1 is a side, sectional view of an indirect fired process heater apparatus constructed in accordance with the present invention.
Figure 2:
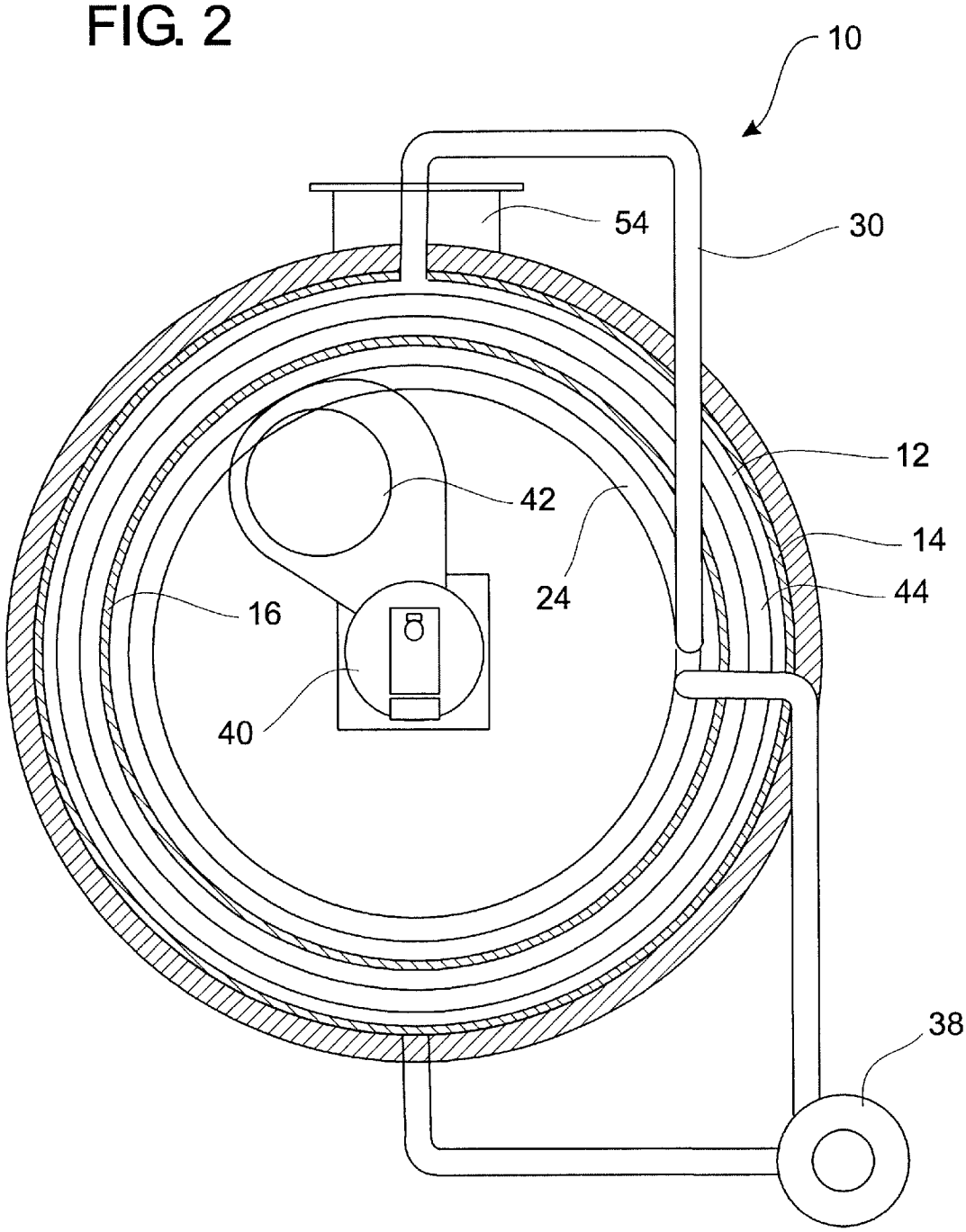
FIG. 2 is an end view of the indirect fired process heater apparatus shown in FIG. 1.

Referring to the drawings in detail, FIG. 1 illustrates a cross-sectional view of an indirect fired process heater apparatus 10 constructed in accordance with the present invention while FIG. 2 illustrates an end view. The apparatus includes a toroidal shell 12 having an outer cylinder 14 and a smaller diameter inner cylinder 16. The outer cylinder 14 and the inner cylinder 16 together form a fluid tight enclosure for containing heat transfer fluid as will be described in detail herein. The outer cylinder 14 along with end walls 18 and 20 form the exterior of an enclosed containment vessel. In the present embodiment, the containment vessel is in the form of a cylinder having an axis 22 illustrated by dashed lines.

A plurality of helical heat transfer coils 24 are positioned within the containment vessel and are coaxial therewith, having the same axis shown by dashed line 22. The heat transfer coils 24 contain a heat transfer fluid which passes therein and therethrough as shown by the cut away portion. The heat process coils 24 may be of various dimensions and, in a preferred embodiment, are 4 inches or less in diameter.

The heat transfer fluid may be any number of fluids and, in one application, is a mixture of water and glycol. Various types of glycol may be employed. It will be understood that various other fluids may be employed which are suitable for the selected design pressure and temperature conditions.

The heat transfer fluid enters through an intake 26 to the helical coils, passes through the helical coils 24 and thereafter exits through an out take 28. Thereafter, the heat transfer fluid is directed through a line 30 into the toroidal shell 12 formed by the outer cylinder 14 and inner cylinder 16. The heat transfer fluid circulates through the toroidal shell and thereafter returns with force from pump 38 via line 32 back to the intake 26. In the present embodiment, the heat transfer fluid enters one end of the vessel and exits the same end although other arrangements are possible.

An added advantage of the present invention is that since the toroidal shell forms the exterior of the apparatus, the normal required insulation or refractory lining of the inner shell 16 is eliminated.

A fluid expansion tank 34 in communication with the toroidal shell is provided to accommodate expansion of the heat transfer fluid when heated. It will be appreciated from the foregoing that the heat transfer fluid is in a circulating, closed loop system.

A burner 40 at one end of the vessel, in this case end wall 20, supplies heat to an axial passageway formed by the helical heat transfer fluid coils 24. Hot flue gas from the burner 40 is directed into and through the axial passageway by a fan 42 or blower, or natural draft burners visible in FIG. 2.

The flue gases directed by the fan 42 or blower or natural draft burner passes generally axially through the axial passageway toward the opposite end wall 18.

A plurality of helical process fluid heating coils 44 are positioned within the apparatus 10 and are coaxial with but independent from the heat transfer fluid coils 24. Stated in other words, the fluid system of the heat transfer fluid coils is independent from the fluid system of the process fluid coils.

The process fluid heating coils 44 pass through the toroidal shell 12 so that the coils 44 are in heat exchange relationship with the heat transfer fluid of glycol and water. As shown in the present embodiment, the process fluid, such as natural gas, enters through an intake 45, passes and circulates through the helical process heating coils 44 and thereafter exits through an out take 48. In the embodiment shown, the process fluid enters one end of the vessel and exits the same end but other arrangements are possible.

The helical process fluid heating coils 44 have an axial diameter or diameters which are intermediate between the outer cylinder 14 and the inner cylinder 16. By way of example but not by way of limitation, the helical process fluid heating coils may be 4" or less in diameter. Accordingly, heat from the heat transfer fluid is passed to the process fluid, such as natural gas.

Hot flue gas generated by the burner 40 passes into and through the axial passageway formed by the helical heat transfer fluid coils 24. The flue gas generated by the burner 40 and moved by the fan 42, blower or natural draft burners thereafter reverses direction as shown by arrows 50. The hot flue gases make a 180° turn and pass through an annulus formed by the exterior of the heat process coils 24 and the inner cylinder 16 of the toroidal shell 12. Heat from the flue gas is also transferred to the heat transfer fluid while in the toroidal shell. Thereafter, flue gases are permitted to move in the direction shown by arrow 52 through and out of an exhaust stack 54 extending radially from the apparatus.

In the preferred embodiment disclosed herein, the toroidal shell 12, the heat process coils 24 and the process heating coils 44 are all coaxial with each other.

The operation of the apparatus 10 in the present invention will be accomplished by initially heating the heat transfer fluid in the helical heat process coils 24 with hot flue gas generated from the burner 40 and directed by the fan 42 or blower or natural draft burner through an axial passageway formed by the heat transfer coils 24. The heat transfer fluid is circulated via a pump 38 through the helical heat transfer coils and thereafter directed to the toroidal shell 12 having an outer cylinder and inner cylinder to form a fluid tight enclosure. Heat from the heat transfer fluid is transferred to the process fluid. The relatively cooler heat transfer fluid is thereafter circulated back to the heat transfer coils by a pump 38 so that a closed loop fluid system is formed. In one embodiment, the circulating heat transfer fluid is heated up to approximately 250° F., although other temperatures are possible.

The process fluid to be processed, such as natural gas, is directed into the apparatus 10 and through a plurality of the helical process heating coils 44 wherein the process heating coils pass through the toroidal shell in heat transfer relationship with the heat transfer fluid.

The flue gas generated by the burner 40 and directed by fan 42 or blower is directed through the axial passageway and thereafter through an annulus formed by a space between the heat transfer coils 24 and the inner cylinder 16 of the toroidal shell 12.

Figure 3:
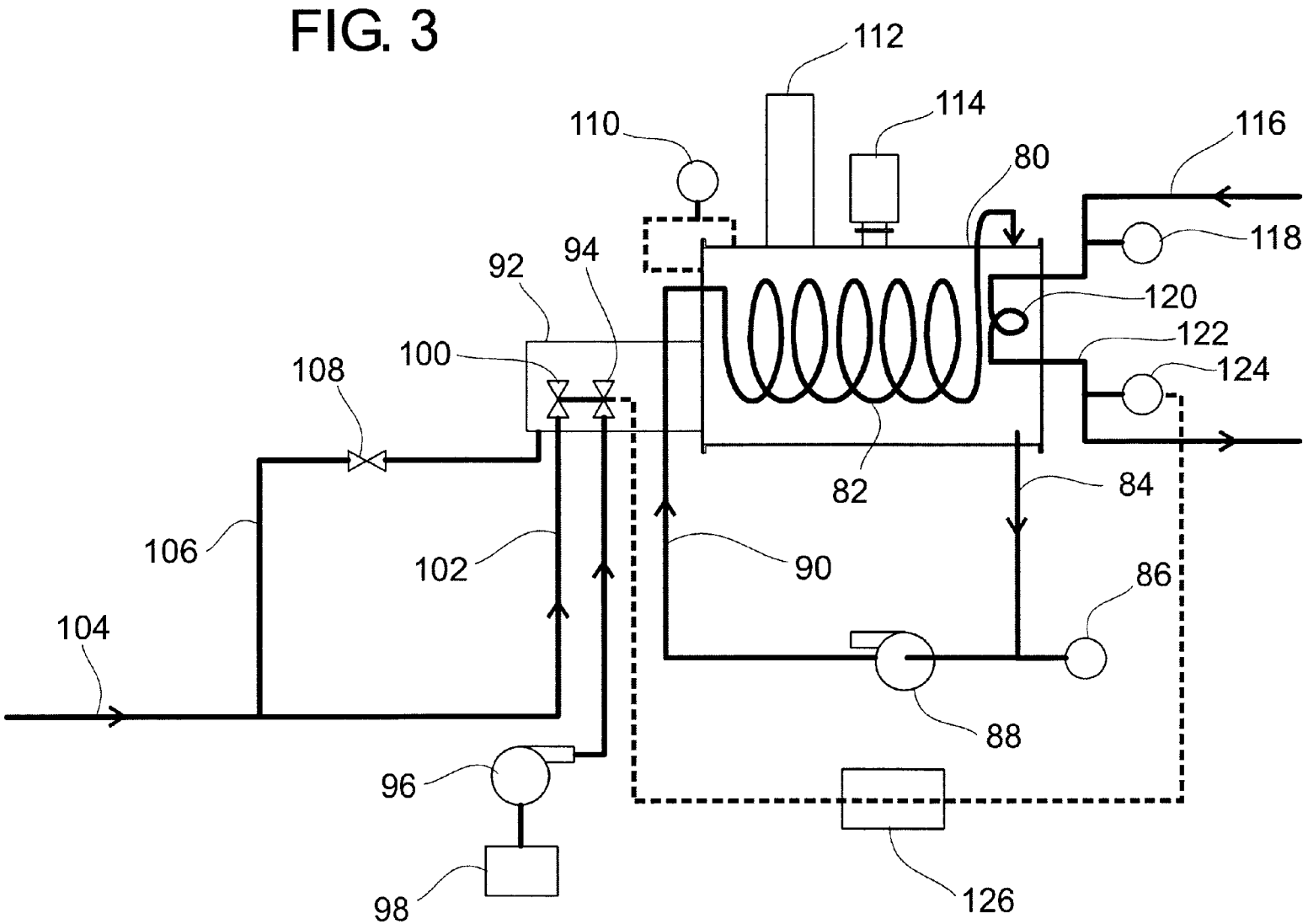
FIG. 3 is a simplified schematic diagram of the indirect fired process heater shown in FIG. 1.

FIG. 3 illustrates a simplified schematic diagram of the operation of the indirect fired process heater 10 of the present invention. Box 80 diagrammatically depicts the toroidal shell 12 which forms a containment vessel for the heater apparatus 10. The helical heat transfer fluid coils 82 pass through the cylindrical toroidal shell 80 having an outer cylinder and an inner cylinder. Heat transfer fluid in the coils 82 passes into the toroidal shell and circulates from the apparatus as shown by arrow 84 and past a thermometer 86. The heat transfer fluid is moved by a pump 88 and thereafter circulated back through the heat transfer coils as illustrated by arrow 90.

Burner 40 illustrated by box 92 includes a valve 94 for regulating air moved by a fan or blower 96 driven by a motor 98. The burner also includes a valve 100 for regulating a fuel gas line 102 so that fuel to the burner is delivered as shown by arrow 104. A line 106 with a valve 108 may be provided for a pilot light mechanism.

A thermometer 110 monitors temperature of the heat transfer fluid in the toroidal shell. An exhaust stack 112 draws off the products of combustion from the burner 92 which have passed through the vessel. An expansion tank 114 provides room for expansion of the heat transfer fluid when heated.

Finally, process fuel line 116 shows an inlet which passes a thermometer 118 and thereafter through the helical process fluid coils 120 which pass through the toroidal shell. The process fluid is thereby heated. Thereafter, the process fluid is directed to an outflow 122 and passes a temperature sensor 124. The temperature sensor 124 operates a control mechanism 126 which controls the air valve 94 and fuel valve 100 to increase or decrease heat to the apparatus in order to maintain a desired outflow temperature of the process fluid.

EXAMPLE

In one example of an application of the present invention, an indirect fired process heater 10 constructed in accordance with the teachings of the present invention may be compared to the typical, prior art indirect fired process heater wherein a vessel is filled with heat transfer fluid. The heat transfer fluid in the typical prior art heater remains static in the vessel and is not circulated.

The following are equivalent heater units in that each transfer three million (3,000,000) BTU/hr to a process fluid, such as natural gas, during similar flow conditions:

| | STANDARD HEATER | APPLICANT'S HEATER |
|---|---|---|
| Shell Diameter (inches) | 60 | 56 |
| Shell Length (feet) | 24.6 | 15 |
| Weight in Pounds (including heat transfer fluid) | 33,700 | 18,400 |
| Heat Transfer Fluid in Gallons | 2,588 | 248 |

As can be seen by the foregoing, an indirect fired process heater constructed in accordance with the present invention would be approximately half the weight of a standard indirect process heater. An indirect fired process heater of the present invention would require a much smaller heat transfer volume charge, requiring only 1/10 of the heat transfer fluid. The overall size of the vessel would also be reduced from a standard indirect process heater.

Finally, because of the size and fluid reductions, the present invention may be started up from cold condition to full flow use condition in a substantially shorter time.

Whereas, the present invention has been described in relation to the drawings attached hereto, it should be understood that other and further modifications, apart from those shown or suggested herein, may be made within the spirit and scope of this invention.

What is claimed is:

1. An indirect fired process heater apparatus, which comprises:

a toroidal shell having an outer cylinder and an inner cylinder forming a fluid tight enclosure;

a plurality of helical heat transfer coils forming an axial passageway wherein said coils have heat transfer fluid passing therein;

a burner directing hot gas into said axial passageway;

said toroidal shell in fluid communication with said heat transfer coils to circulate said heat transfer fluid therethrough; and a plurality of helical process heating coils passing through said toroidal shell to heat process fluid passing through said process heating coils.

2. An indirect fired process heater apparatus as set forth in claim 1 wherein said helical heat transfer coils are coaxial with said toroidal shell and have a smaller diameter than said toroidal shell.

3. An indirect fired process heater apparatus as set forth in claim 1 wherein said helical process heating coils are coaxial with said toroidal shell and said process heating coils have a diameter intermediate said outer cylinder and said inner cylinder.

4. An indirect fired process heater apparatus as set forth in claim 1 wherein said heat transfer fluid contains at least water and glycol.

5. An indirect fired process heater apparatus as set forth in claim 1 including a fluid expansion tank extending from and in fluid communication with said toroidal shell.

6. An indirect fired process heater apparatus as set forth in claim 1 including a circulating pump in order to circulate said heat transfer fluid through said helical heat transfer coils and through said toroidal shell.

7. An indirect fired process heater apparatus as set forth in claim 1 including an exhaust stack for releasing exhaust gas from said fire tube.

8. An indirect fired process heater apparatus as set forth in claim 1 wherein said cylindrical shell, said helical heat transfer coils, and said process heating coils are coaxial.

9. An indirect fired process heater as set forth in claim 1 wherein said hot gas from said burner is directed by a fan or blower through said axial passageway formed by said helical heat transfer coils and thereafter through an annulus between said helical transfer coils and said toroidal shell.

10. An indirect fired process heater apparatus as set forth in claim 1 wherein said toroidal shell forming a fluid tight enclosure is a containment vessel.

11. An indirect fired process heater apparatus as set forth in claim 1 wherein said burner includes air and gas valves to regulate said heat.

12. An indirect fired process heater apparatus, which comprises:

a plurality of helical heat transfer coils wherein said coils have heat transfer fluid therein;

a burner directing hot gas into a passageway formed by said helical heat transfer coils;

a toroidal shell in fluid communication and coaxial with said heat transfer coils to pass heat transfer fluid therethrough; and a plurality of helical process heating coils passing through said toroidal shell and coaxial therewith so that process fluid passing through said process heating coils is heated.

13. An indirect fired process heater apparatus as set forth in claim 12 including a fan or blower to direct heat through said axial passageway in a first direction and thereafter through an annulus between said helical transfer coils and said toroidal shell in a reverse direction.

14. A method to heat process fluid, which method comprises:

heating heat transfer fluid in a plurality of helical heat transfer coils with hot gas from a burner;

circulating said heat transfer fluid through said helical heat transfer coils and a toroidal shell having an outer cylinder and an inner cylinder forming a fluid tight enclosure; and directing process fluid through a plurality of helical process heating coils wherein said process heating coils pass through said toroidal shell in order to heat said process fluid.

15. A method to heat process fluid as set forth in claim 14 wherein said heat transfer fluid is circulated by a pump.

16. A method to heat process fluid as set forth in claim 14 wherein said heat transfer fluid includes at least water and glycol.

17. A method to heat process fluid as set forth in claim 14 including the step of directing hot gas through a passageway.

* * * * *